US008337164B2

(12) United States Patent
Ohbayashi et al.

(10) Patent No.: US 8,337,164 B2
(45) Date of Patent: Dec. 25, 2012

(54) TURBOMOLECULAR PUMP

(75) Inventors: Tetsuro Ohbayashi, Osaka (JP); Takeshi Shoji, Osaka (JP)

(73) Assignee: Osaka Vacuum, Ltd. (JP)

( * ) Notice: Subject to any disclaimer, the term of this patent is extended or adjusted under 35 U.S.C. 154(b) by 727 days.

(21) Appl. No.: 12/500,066

(22) Filed: Jul. 9, 2009

(65) Prior Publication Data

US 2011/0008176 A1 Jan. 13, 2011

(30) Foreign Application Priority Data

Jul. 22, 2008 (JP) ..... 2008-188085

(51) Int. Cl.
*F04D 29/18* (2006.01)

(52) U.S. Cl. ..... 416/242

(58) Field of Classification Search ..... 415/55.1, 415/55.2; 416/175, 223 A, 242, 243
See application file for complete search history.

(56) References Cited

U.S. PATENT DOCUMENTS 2,935,246 A * 5/1960 Roy ..... 415/181
3,128,939 A * 4/1964 Syzdlowski ..... 416/242
4,622,687 A * 11/1986 Whitaker et al. ..... 378/130
6,474,940 B1 * 11/2002 Yamauchi et al. ..... 415/90
6,910,861 B2 * 6/2005 Beyer et al. ..... 415/211.2
2003/0108418 A1 * 6/2003 Yu ..... 415/55.1
2007/0264118 A1 * 11/2007 Ishii et al. ..... 415/72

FOREIGN PATENT DOCUMENTS

EP 1354138 11/2001
JP 3532653 3/2004

OTHER PUBLICATIONS

German Office Action (German Patent Appl. No. 102009027834.6) and its English translation.

* cited by examiner

*Primary Examiner* — Ninh H Nguyen
*Assistant Examiner* — Joshua R Beebe
(74) *Attorney, Agent, or Firm* — Berliner & Associates

(57) ABSTRACT

An object is to provide a turbomolecular pump with rotor and stator blades alternatively arranged that can prevent collision between the adjacent rotor and stator blades due to air inrush, which may take place due to vacuum break in a system operation, prevent excessive centrifugal force to a hub portion of a rotor, and further enhance pumping performance. A blade cross sectional profile taken along the circumferential direction of each of the rotor blades of a rotor blade stage has an upstream portion curved convexly backward in a rotational direction of the rotor and a downstream portion curved convexly forward in the rotational direction of the rotor, thereby forming the blade cross sectional profile into an S-shape or inversed S-shape.

4 Claims, 10 Drawing Sheets

FIG. 4

| Blade shape | Reference blade angle (degree) | Non-dimensional pumping speed | Non-dimensional back flow velocity |
|---|---|---|---|
| Wave-shaped blade | 33.1 | 0.28988 | 0.0612 |
| Flat plate blade | 35 | 0.24864 | 0.1246 |
| Inversed wave-shaped blade | 39.9 | 0.18604 | 0.3534 |
| Blade oriented convexly forward in the rotational direction | 37.6 | 0.23191 | 0.4345 |
| Blade oriented convexly backward in the rotational direction | 37.6 | 0.23415 | 0.4329 |

TURBOMOLECULAR PUMP

CROSS REFERENCE TO RELATED APPLICATION

This application claims priority from Japanese Patent Application No. 2008-188085, which is incorporated herein by reference.

BACKGROUND OF THE INVENTION

1. Field of the Invention

The present invention relates to a turbomolecular pump for use in a ultra-high vacuum system and a vacuum generation system required for manufacturing ICs, semiconductors and the like.

2. Related Art

A turbomolecular pump has a pumping section that includes multi stages of rotor blades having a shape similar to those of an axial flow compressor, and multi stages of stator blades alternatively arranged with the rotor blades.

There is known a case in which a new theoretical concept is applied to designing of the blades of this turbomolecular pump to provide effective compression capability and pumping speed not only in a free molecule flow region but also an intermediate flow region (cf. for example, Patent Document 1).

[Patent Document 1] Japanese Patent No. 3532653

FIG. 9 is a vertical cross sectional view of one example of a conventional turbomolecular pump. A rotor a is made up of an axial flow blade row that is composed of a large number of axial flow blades c arranged in multi stages and projecting outwards from a hub portion b.

Blades c of the axial flow blade row each are formed by a flat plate blade and one example of a development view in cross section in the circumferential direction of the axial flow blade row is shown in FIG. 10.

A blade row of a turbomolecular pump disclosed in the Patent Document 1 is made up of flat plate blades, as shown in FIG. 2 of this Patent Document 1.

The flat plate blade of this type has a small bending rigidity and therefore sudden vacuum break may take place in a vacuum portion on the upstream side, and if air inrush enters into a rotor section under this condition, the blades are greatly deformed and the adjacent rotor and stator blades resultingly collide with each other, which may cause a serious accident.

In order to prevent such collision due to air inrush, the rotor blades need to be thickened but the thickening of the rotors poses a problem of increasing stress on the inner circumference of a hub of the rotor.

Accordingly, it is an object of the present invention to provide a turbomolecular pump provided with rotor blades that solve those problems, have a high bending rigidity, prevent occurrence of excessive inner stress to the hub portion of the rotor, and have more excellent pumping performance than flat plate blades.

SUMMARY OF THE INVENTION

In order to achieve the above object, there is provided a turbomolecular pump provided with multi-stages of axial flow blades that includes a rotor made up of multi-stages of rotor blades, in which rotor blades of at least one stage each have a blade cross sectional profile taken along the circumferential direction of the rotor, which profile having an upstream portion curved convexly backward in a rotational direction of the rotor and a downstream portion curved convexly forward in the rotational direction of the rotor, thereby forming the blade cross sectional profile into any one of an S-shape and an inversed S-shape.

With this arrangement, it is possible to prevent collision between the adjacent rotor and stator blades due to air inrush, which may enter into the rotor, by increasing the high bending rigidity of the blades, which is achieved without the necessity to increase the stress on the inner circumference of the hub of the rotor.

It is also possible to increase the pumping speed in a viscous flow region.

BRIEF DESCRIPTION OF THE DRAWINGS

FIG. 4 is a table for explaining the aforesaid performance.

DESCRIPTION OF THE PREFERRED EMBODIMENTS

Description will be made for the preferred embodiments of the present invention.

Embodiment 1

Now, the description will be made for Embodiment 1 of the present invention with reference to FIGS. 1 to 4.

Figure 1:
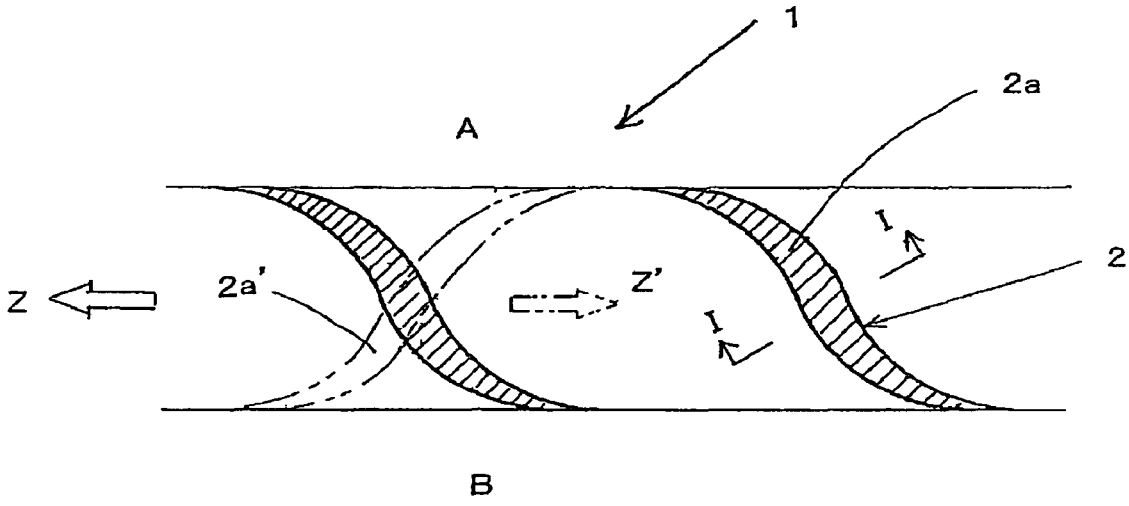
FIG. 1 is a cross sectional development view taken along a circumferential direction of a stage of rotor blades of a turbomolecular pump according to Embodiment 1 of the present invention.
Figure 2:
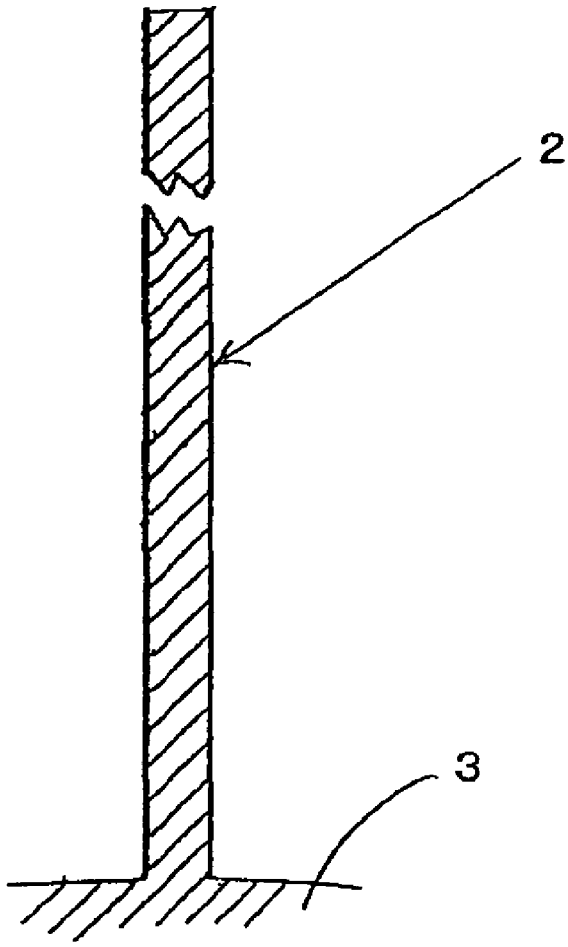
FIG. 2 is an end view taken along a line I-I in FIG. 1.

FIG. 1 is a development view of a stage of rotor blades (hereinafter referred to as a rotor blade stage 1) of a turbomolecular pump according to Embodiment 1 of the present invention, and FIG. 2 is a vertical cross section (end view taken along a line I-I in FIG. 1) of rotor blades 2 of the rotor blade stage 1.

An arrow Z represents the rotational direction of the rotor blade stage 1, A represents an upstream side of the rotor blades 2 (i.e., an upstream side in the axial gas flow direction of the pump) and B represents a downstream side of the rotor blades 2 (i.e., a downstream side in the axial gas flow direction of the pump).

As shown in FIGS. 1 and 2, the rotor blades 2 each have a blade cross sectional profile 2*a* taken along the circumferential direction of the rotor that has an upper portion or an upstream portion close to an inlet of the pump, and a lower portion or a downstream portion close to an outlet of the pump, and each are mounted to a hub portion 3 of a rotor so as to have the upstream portion oriented diagonally forward in the rotational direction and the downstream portion oriented diagonally backward in the rotational direction. Furthermore, according to the blade cross sectional profile 2*a* taken along the circumferential direction of the rotor, the upstream portion is curved convexly backward in the rotational direction, and the downstream portion is curved convexly forward in the rotational direction, thereby forming the center line of the blade cross sectional profile 2*a* into an inversed S-shape. Furthermore, the blade cross sectional profile 2*a* of each of the rotor blades 2 has a thickness gradually decreasing from the center portion to the opposite end portions to thereby make the opposite end portions thinnest.

In this embodiment, the blade cross sectional profile 2*a* is formed into an inversed S-shape on the assumption that the rotor blade stage 1 is rotated in a leftward direction represented by an arrow Z in FIG. 1A. Accordingly, in a case where the rotor blade stage 1 is rotated in the opposite direction or a rightward direction represented by an arrow Z', the shape of the blade cross sectional profile 2*a*' is formed into an S-shape as represented in chain double-dashed line of FIG. 1A.

The rotor blades 2 have the same cross sectional shape as that represented by the blade cross sectional profile 2*a* throughout from a distal end portion (blade tip) to a proximal end portion.

Now, the description will be made for the function and effect of a turbomolecular pump having the rotor blade stage 1 of this embodiment.

Since the center line of the blade cross sectional profile 2*a* of the rotor blade 2 is formed into an inversed S-shape to be a wave-shaped blade, it is possible to greatly increase the bending rigidity of the rotor blade 2 as compared with a conventional flat plate blade and hence prevent collision between the adjacent rotor and stator blades due to air inrush.

Since the blade cross sectional profile 2*a* has a thickness gradually decreasing towards the opposite ends, the weight of the rotor blade is rather reduced than a conventional flat plate blade and thus the bending rigidity of the blade can be improved without increasing the stress on the inner circumference of the hub portion 3.

Since the upstream end portion and the downstream end portion, of the blade cross sectional profile 2*a* each have an inclined blade angle, it is possible to increase the pumping speed in a viscous flow region and hence increase the pumping performance of the turbomolecular pump.

Figure 3:
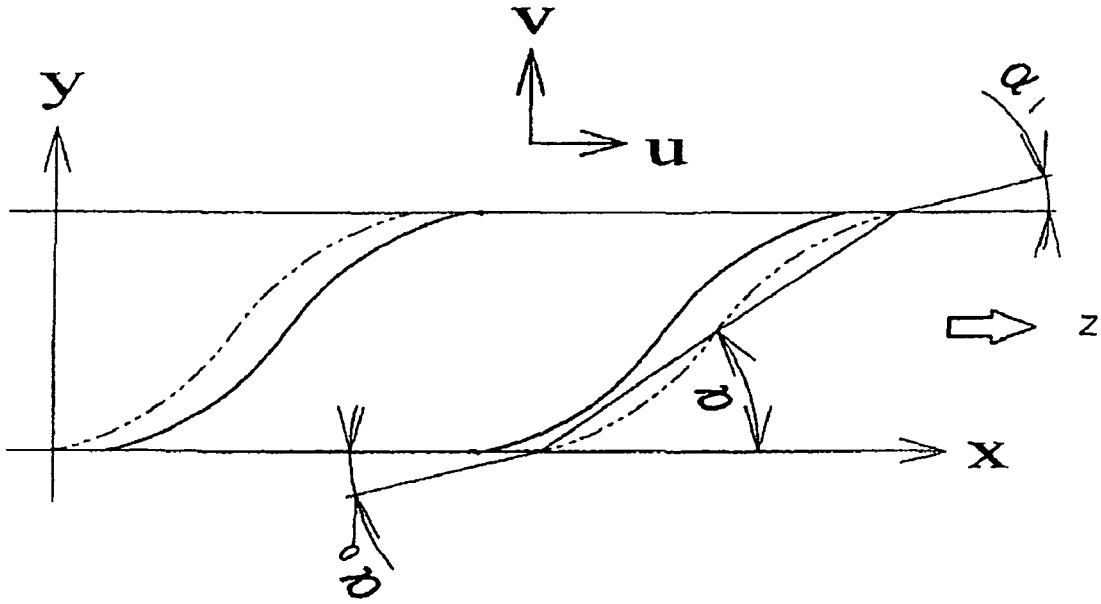
FIG. 3 is an explanatory view for explaining the performance of the Embodiment 1.

The reason why this pumping performance is increased will be explained with reference to FIGS. 3 and 4.

In the turbomolecular pump, a flow between the blades is a molecular flow or viscous flow, and therefore the inertia force of gas can be ignored as compared with the pressure difference or viscous force, unlike a conventional axial flow turbo machine.

Now, the description will be made for the action of a rotor blade by taking for example a case where the pitch/cord ratio is 1 and the reference blade angle $\alpha$ is 35 degrees for a flat plate blade.

As shown in TABLE of FIG. 4, a flow simulation analysis is made by a computer for five different blades, namely a wave-shaped blade (a blade of the present invention), a flat plate blade, an inversed wave-shaped blade, a blade oriented convexly forward in the rotational direction, and a blade oriented convexly backward in the rotational direction to compare the non-dimensional pumping speed with the non-dimensional back flow velocity.

By the "inversed wave-shaped blade" is herein meant a blade having a blade cross sectional profile formed into an S-shape or inversed S-shape by having the upstream side of the blade cross sectional profile curved convexly forward in the rotational direction and the downstream side curved convexly backward in the rotational direction.

As a result, the flow rate of the fluid is increased in the order of "the inversed wave-shaped blade<the blade oriented convexly forward in the rotational direction<the blade oriented convexly backward in the rotational direction<the flat plate blade<the wave shaped blade", and it was found that the ratio thereof is 0.75:0.93:0.94:1:1.17.

Specifically, since the non-dimensional pumping speed in the TABLE of FIG. 4 is a ratio of a v component of an average inflow/outflow velocity relative to the blade velocity, the average inflow/outflow angle of a wave shaped blade is about 16 degrees with reference to the rotational direction. Accordingly, when the blade angle ($\alpha_I$) on the inlet side of the blade and the blade angle ($\alpha_O$) on the outlet side is about 16 degrees, which is equal to the average inlet/outlet angle, gas can flow without being disturbed. Thus, it was found that a blade angle of the inlet side and the outlet side is preferably about 17 degrees smaller than 33.1 degrees of the reference blade angle $\alpha$.

As such, by having the upstream portion of the blade cross sectional profile curved convexly backward in the rotational direction to have a blade angle ($\alpha_I$) of a blade edge portion inclined, and having the downstream portion of the blade cross sectional profile curved convexly forward in the rotational direction to have a blade angle ($\alpha_O$) of a blade edge portion B inclined, it is possible to enhance the pumping performance as compared with a straight flat plate blade.

Embodiment 2

Now, the description will be made for Embodiment 2 with reference to FIGS. 5 and 6.

Figure 5:
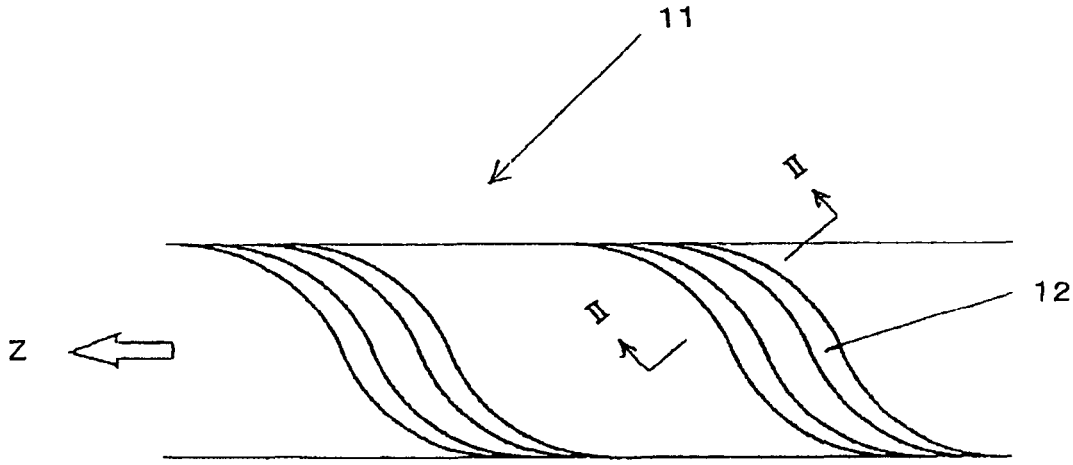
FIG. 5 is a cross sectional development view taken along a circumferential direction of a stage of rotor blades of a turbomolecular pump according to Embodiment 2 of the present invention.

FIG. 5 is a cross sectional development view taken along a circumferential direction of a rotor blade stage 11 of a turbomolecular pump according to this embodiment, in which a reference numeral 12 represents a rotor blade of the rotor blade stage 11.

Figure 6:
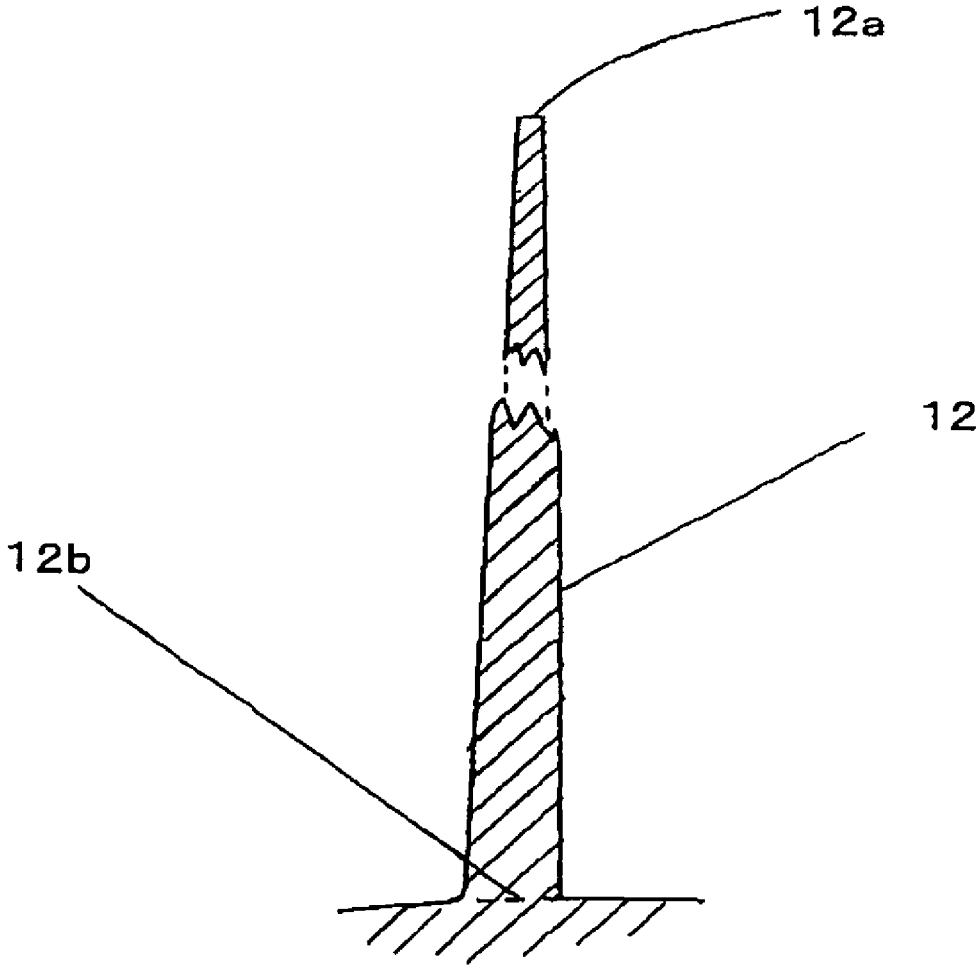
FIG. 6 is an end view taken along a line II-II in FIG. 5.

FIG. 6 is an end view taken along a line II-II in FIG. 5 (vertical cross sectional view of the rotor blade 12).

The rotor blade 12 of this embodiment has a blade cross sectional profile similar to that of Embodiment 1 having the center line of the blade cross sectional profile formed into an inversed S-shape, having a thickness gradually decreasing from the center portion to the opposite ends, of the blade cross sectional profile, and further having a thickness of the center portion of the blade gradually increasing from a distal end portion (blade tip) 12*a* to a proximal end portion 12*b*, of the rotor blade 12.

Since the blade cross sectional area gradually increases from the distal end portion 12*a* to the proximal end portion 12*b*, of the rotor blade 12, so that the rotor blade 12 of this embodiment has a further increased bending rigidity, and hence the possibility of collision between the adjacent rotor and stator blades due to air inrush, which may enters into the rotor, can be further reduced.

Embodiment 3

Now, the description will be made for Embodiment 3 of the present invention with reference to FIGS. 7 and 8.

Figure 7:
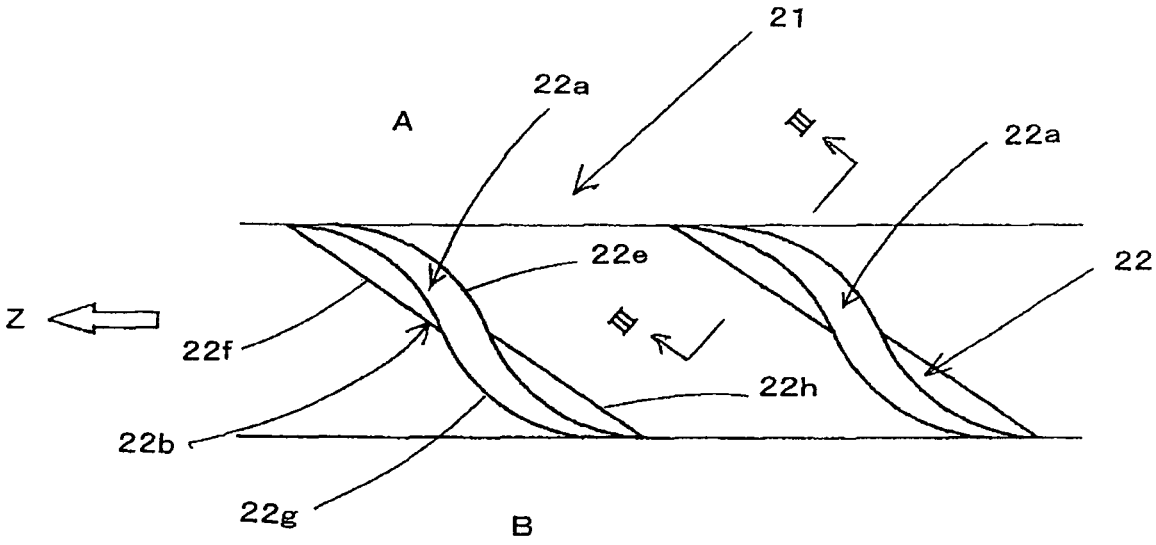
FIG. 7 is a cross sectional development view taken along a circumferential direction of a stage of rotor blades of a turbomolecular pump according to Embodiment 3 of the present invention.

FIG. 7 is a cross sectional development view taken along a circumferential direction of a rotor blade stage 21 of a turbomolecular pump according to this embodiment, in which a reference numeral 22 represents a rotor blade of the rotor blade stage 21.

Figure 8:
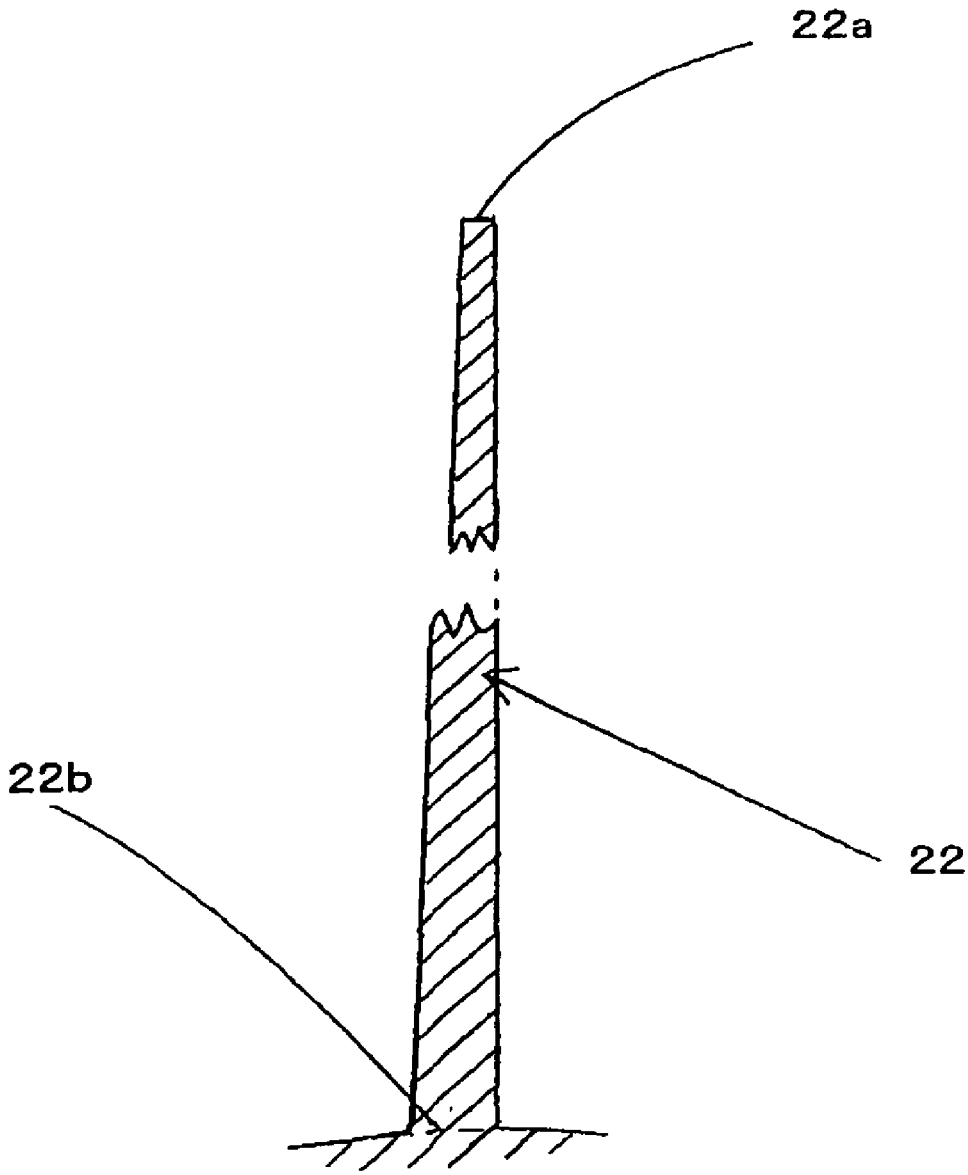
FIG. 8 is an end view taken along a line III-III in FIG. 7.
Figure 9:
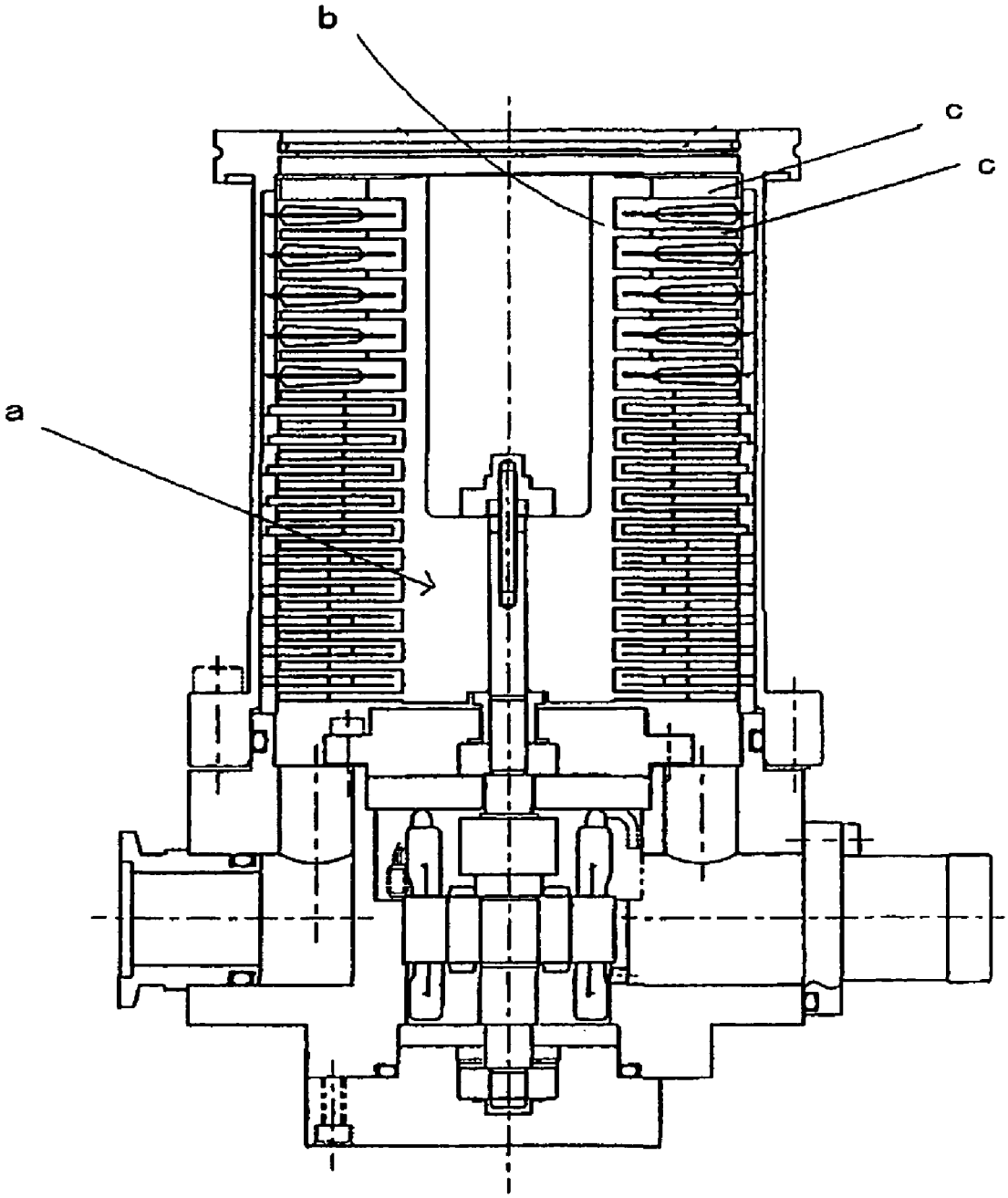
FIG. 9 is a vertical cross section of one example of a conventional turbomolecular pump.
Figure 10:
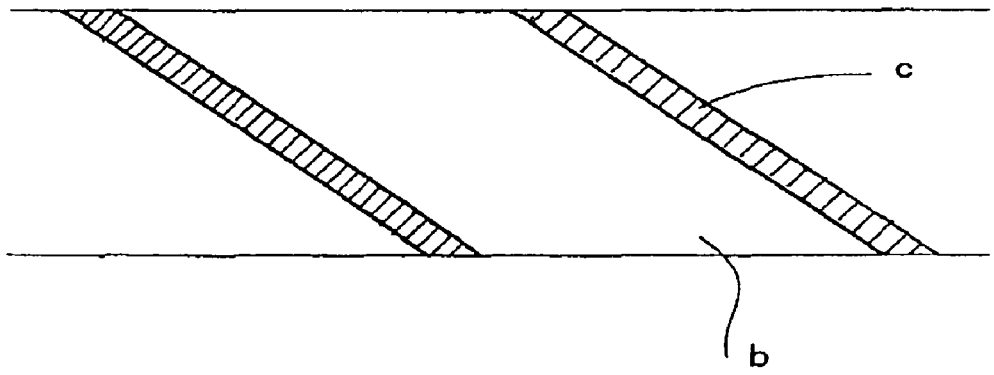
FIG. 10 is a cross sectional development view taken along a circumferential direction of an axial flow blade row of a conventional turbomolecular pump.

FIG. 8 is an end view taken along a line III-III in FIG. 7 (vertical cross sectional view of the rotor blade 22).

The rotor blade 22 has a blade cross sectional profile similar to that of Embodiment 1, in which a shape of the distal end portion (blade tip) 22*a* is formed into an inversed S-shape and the thickness of the blade is thin at the opposite end portions.

According to the blade cross sectional profile of the proximal end portion 22*b* of the rotor blade 22, a rear surface side 22*e* of the upstream portion is curved convexly backward in the rotational direction and a front surface side 22*f* of the upstream portion is formed straight, and a front surface side 22*g* of the downstream portion is curved convexly forward in the rotational direction and a rear surface side 22*h* of the downstream portion is formed straight, thus forming the blade cross sectional profile of the proximal end portion 22*b* into a bow-tie like shape.

The cross section at an intermediate portion between the distal end portion 22*a* and the proximal end portion 22*b*, of the rotor blade 22 thus has a profile defined by envelop curves connecting between the distal end portion 22*a* and the proximal end portion 22*b*.

The envelope curves are comprised of a group of curved lines connecting the curved outline of the blade distal end portion 22*a* and the curved outline of the blade proximal end portion 22*b*, and the envelope curves comprised of these curved lines constitute the shape of the profile of the rotor blade 22.

Since the rotor blade 22 of this embodiment also has a cross sectional area gradually increasing from the distal end portion 22*a* to the proximal end portion 22*b*, it is possible to produce an effect of increasing the bending rigidity and hence provide a turbomolecular pump having a better pumping performance.

This specification is by no means intended to restrict the present invention to the preferred embodiments set forth therein. Various modifications to the turbomolecular pump, as described herein, may be made by those skilled in the art without departing from the spirit and scope of the present invention as defined in the appended claims.

What is claimed is:

1. A turbomolecular pump provided with multi-stages of axial flow blades, comprising a rotor made up of multi-stages of rotor blades, in which rotor blades of at least one stage each have a blade cross sectional profile taken along the circumferential direction of the rotor, which profile having an upstream portion curved convexly backward in a rotational direction of the rotor and a downstream portion curved convexly forward in the rotational direction of the rotor, thereby forming the blade cross sectional profile into any one of an S-shape and an inversed S-shape, wherein a blade cross sectional profile of a distal end portion of each of the rotor blades is shaped to have a rear surface side of the upstream portion oriented convexly backward in the rotational direction, a front surface side of the upstream portion oriented concavely backward in the rotational direction, a rear surface side of the downstream portion oriented concavely forward in the rotational direction and a front surface side of the downstream portion oriented convexly forward in the rotational direction, thereby forming the blade cross sectional profile of the distal end portion into any one of an S-shape and an inversed S-shape; wherein a blade cross sectional profile of a proximal end portion of the rotor blade is shaped to have a rear surface side of the upstream portion oriented convexly backward in the rotational direction, a front surface side of the upstream portion shaped straight without concave, a front surface side of the downstream portion oriented convexly forward in the rotational direction and a rear surface side of the downstream portion shaped straight without concave, and wherein a cross sectional profile of an intermediate portion between the distal end portion and the proximal end portion, of the rotor blade is shaped to be a cross sectional profile defined by envelope curves connecting between the blade cross sectional profile of the distal end portion and the blade cross sectional profile of the proximal end portion.

2. The turbomolecular pump according to claim 1, wherein the blade cross sectional profile of each of the rotor blades is shaped to have a thickness gradually decreasing from a center portion to opposite end portions respectively positioned downstream and upstream of the blade cross sectional profile.

3. The turbomolecular pump according to claim 1, wherein the blade cross sectional profile of each of the rotor blades is shaped to have a thickness of a center portion gradually increasing from a distal end portion to a proximal end portion, of the rotor blade.

4. The turbomolecular pump according to claim 2, wherein the blade cross sectional profile of each of the rotor blades is shaped to have a thickness of a center portion gradually increasing from a distal end portion to a proximal end portion, of the rotor blade.

* * * * *